United States Patent [19]

Morikawa

[11] 4,126,421

[45] Nov. 21, 1978

[54] CATALYTIC CONVERTER VESSEL

[75] Inventor: Nobutaka Morikawa, Aichi, Japan

[73] Assignee: Toyota Jidosha Kogyo Kabushiki Kaisha, Toyota, Japan

[21] Appl. No.: 775,938

[22] Filed: Mar. 9, 1977

[30] Foreign Application Priority Data

Nov. 29, 1976 [JP] Japan ..... 51/159616[U]

[51] Int. Cl.[2] ..... F01N 3/15; B01J 8/02

[52] U.S. Cl. ..... 422/177; 55/518; 422/176

[58] Field of Search ..... 23/288 F, 288 FB, 288 FC, 23/288 R; 55/518

[56] References Cited

U.S. PATENT DOCUMENTS

| | | | |
|---|---|---|---|
| 3,615,255 | 10/1971 | Patterson et al. | 23/288 F |
| 3,818,667 | 6/1974 | Wagner | 23/288 F X |
| 3,927,984 | 12/1975 | Hartley | 23/288 F |

*Primary Examiner*—James H. Tayman, Jr.
*Attorney, Agent, or Firm*—Brisebois & Kruger

[57] ABSTRACT

Catalytic converter vessel consisting of outer casing 1, inner casing 2 and plates 6, one of said inner casing 2 and said plates being provided with louver holes 4 and the other with punched holes 5, and said inner casing 2 and said plates 6 being assembled together with outer case 1 so that said louver holes 4 are coaxially aligned with said punched holes 5.

7 Claims, 3 Drawing Figures

CATALYTIC CONVERTER VESSEL

BACKGROUND OF THE INVENTION

As a result of the strict enforcement of controls on harmful emissions from the internal combustion engines of vehicles, particularly of automobiles, a catalytic converter has been adopted as one method of reducing these emissions by converting them into less noxious substance due to their reaction when brought into contact with a catalyst. Various types of catalytic converters are available, such as the downflow type and radial type, but the basic principle lies in placing a catalyst in a casing and purifying the exhaust gas by passing it through the catalyst. The vessel to hold this converter has to be heat-resistant and endurable. The inner casing where the exhaust gas is separated from the catalyst is supposed to be the most vulnerable part of the catalytic converter vessel, because it is exposed to exhaust gas at a temperature as high as about 1000° C., as well as to the weight of the catalyst particles and the exhaust gas pressure. To resist the heat and maintain rigidity under high temperature, it is fabricated of a metal plate which is strong enough to withstand high temperature.

Meanwhile the inner casing is bored with numerous holes so tiny as to prevent the catalyst particles from dropping out of the converter and prevent an increase in the exhaust resistance. Since the catalyst particles are usually in the range of 3–4 mm for reasons of productivity, effective area and activity, the tiny holes in the inner casing have to be less than 2.5 mm when measured in the direction of their minor axis. Thus the inner casing is the least productive part in the catalytic converter vessel.

The tiny holes formed in the inner casing are usually punched holes (round or oval) or louver holes on account of the relationship between diameter and plate thickness. In the case of punched holes, the diameter is so small that the punch and die are often broken and many manhours are required to maintain the tools in good condition. In the case of louver holes, the tools can last a long time but the root of a notch in the louver holes is likely to crack under thermal stress repeatedly acting on the inner casing.

The louver holes are formed by shearing without producing any chips from the plate. As illustrated in the oblique view of FIG. 1, only the cut opening is visible from the front, but from the side holes are visible. In said louver holes, stress concentration is likely to develop at the four corners of the sheared part and therefore, when a heavy thermal stress acts repeatedly, a crack is likely to develop from said four corners toward the area between the holes. Thus the durability of a plate formed with louver holes depends on the area between these holes; the wider said area, the less likely to develop a crack and the higher the rigidity; but the exhaust resistance rises.

SUMMARY OF THE INVENTION

The present invention relates to a catalytic converter vessel for exhaust gas purification, which is characterized by increased productivity and durability.

DETAILED DESCRIPTION OF THE INVENTION

Figure 1:
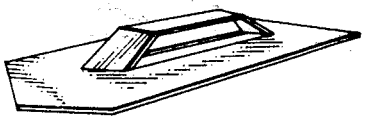
FIG. 1 is an oblique view of a louver hole.
Figure 2:
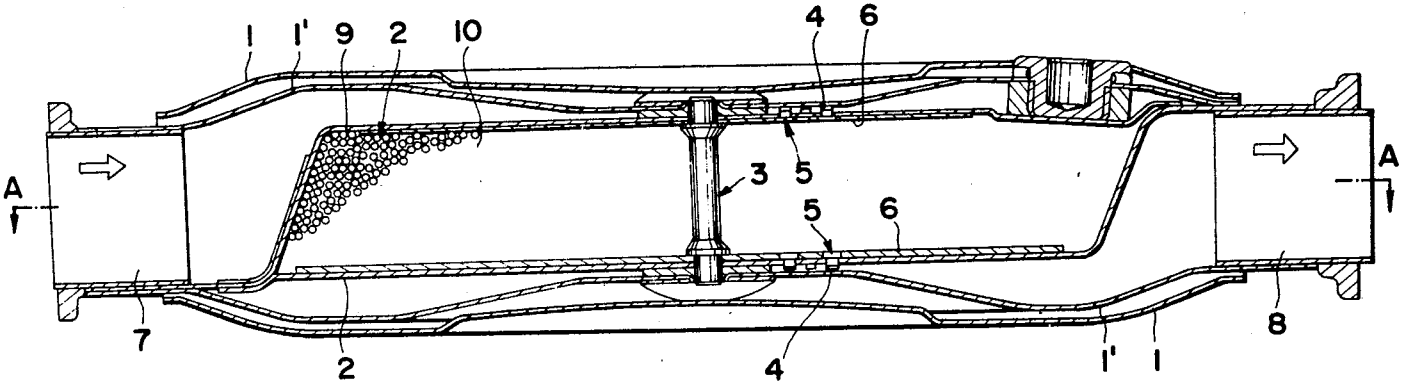
FIG. 2 is a longitudinal sectional view of a catalytic converter vessel according to the present invention.

The present invention will be explained by referring to the drawings. As illustrated in FIG. 2, which is a longitudinal sectional view of the catalytic converter vessel according to the present invention, and in FIG. 3 which is a sectional view taken along the line A–A' of FIG. 2, the catalytic converter vessel according to the present invention consists of outer casings 1, 1', inner casing 2 and center stay bolt 3. The inner casing 2 having louver holes 4 or punched holes 5 is assembled with plates 6 having punched holes 5 or louver holes 4 opposite the louver holes 4 or punched holes 5 of said inner casing 2 so that these holes are concentrically aligned.

Figure 3:
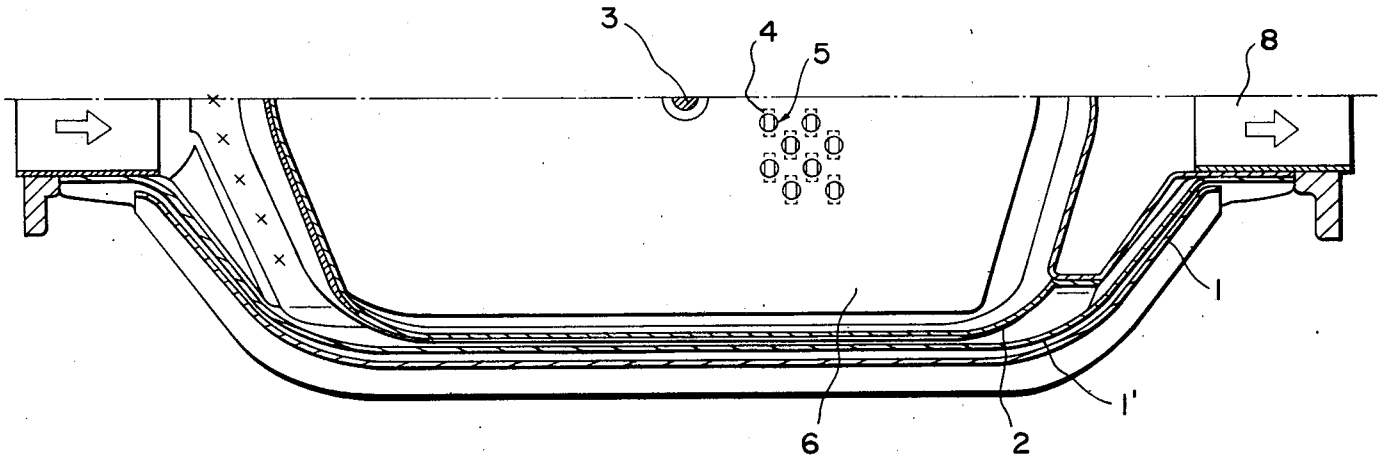
FIG. 3 is a sectional view taken along the line A–A' of FIG. 2.

In FIGS. 2 and 3 is illustrated an assembly comprising inner casing 2 with louver holes 4 laid over plate 6 which has punched holes 5 concentrically aligned with said louver holes 4. It is possible to lay plate 6 with concentric louver holes 4 over the inner casing 2 with punch holes 5. Thus in the present invention, when inner casing 2 is bored with louver holes 4, plate 6 with punched holes 5 is laid under said inner case 2; and when inner casing 2 has punched holes 5, plate 6 with louver holes 4 is laid over said inner case 2, so that the two holes are concentrically aligned. Louver holes and punched holes are provided athwart the exhaust gas flow. In these figures, 7 denotes an exhaust gas inlet; 8 denotes an exhaust gas outlet; 9 denotes a catalyst layer; 10 denotes a catalyst bed; and the arrow indicates the travel direction of the exhaust gas.

According to the present invention, the inner casing 2 and plate 6 are assembled one over the other or under the other so that louver holes 4 come over punched holes 5 in coaxial alignment; and then said inner casing and said plate are spot-welded or arc-welded together. When, however, plate 6 is too small, it may be clampled by means of a center stay bolt 3.

When the thermal expansion of plate 6 is too large in view of the difference in temperature, an L-shaped blanket may be attached in such a way that the inner casing 2 and plate 6 can slide along each other.

In the present invention in which punched holes 5 are located inside of louver holes 4, the punched holes 5 can be made larger in diameter than similar punched holes in conventional inner casings because catalyst particles, even if said punch hole diameter is larger than the minor axis and smaller than the major axis of louver holes 4, can be prevented by the projecting part of louver holes 4 from dropping out. In the present invention, since as described above punched holes 5 are larger in diameter than the minor axis and smaller than the major axis of louver holes 4, the four corners of louver holes 4 can be covered by punched holes 5. In this condition the thermal stress applied to said four corners of louver holes 4 is mitigated and thus cracking is less likely to occur at said four corners and the device can have a long life.

In the catalytic converter vessel according to the present invention, the exhaust gas is conveyed from exhaust gas inlet 7 to catalyst layer 9 of the catalyst bed 10, where said gas is purified; and purified gas goes to the exhaust gas outlet 8. The gas comes into contact with the catalyst as it passes through the punched holes 5 and louver holes 4 of plate 6 and inner casing 2 and, moving through those holes in the direction indicated by the arrow, it goes to exhaust gas outlet 8.

Thus, according to the present invention, in which a plate with punched holes or louver holes is assembled together with an inner casing with louver holes or punched holes, the rigidity of the inner casing is increased and the deformation of the inner case due to the weight of catalyst particles, the exhaust gas pressure and vibration can be prevented, thereby vastly improving the durability of the inner case.

At the same time the louver holes formed in the inner case or in the plate are internally protected by concentric punched holes. In consequence, cracking at the corners of the louver holes can be prevented and accordingly the dropping of catalyst particles out of the catalytic converter can be averted.

Since the punched holes 5 are concentrically aligned with the louver holes, the projecting part of the louver hole is mainly effective for the prevention of catalyst particles from dropping out and therefore the diameter of the punched holes may be made larger than that of a catalyst particle. Thus the frequency with which the punch and die used for boring said punch holes are broken can be reduced and the productivity when manufacturing the inner casing or the plate with punch holes can be remarkably increased.

What is claimed is:

1. A catalyic converter vessel comprising an outer casing, an inner casing within the outer casing, said inner casing comprising a first wall and a second different wall closely adjacent to and extending along said first wall, one of said walls having a plurality of louver openings formed therein, each such louver opening having a major axis greater than its minor axis, the other of said walls having a plurality of punched holes therein of a diameter larger than the minor axis, and smaller than the major axis of the louver openings, said punched holes being centered on and adjacent said louver openings.

2. A catalytic converter vessel as claimed in claim 1, in which said first wall has said louver openings and comprises a wall of said inner casing, and said second wall has said punched holes and comprises a plate on the inside of said first wall.

3. A catalytic converter vessel as claimed in claim 1, in which said first wall has said punched openings and comprises a wall of the inner casing, and said second wall has said louver openings and comprises a plate on the outside of said first wall.

4. A catalytic converter vessel as claimed in claim 1 wherein said first wall comprises a wall of said inner casing, and said second wall comprises a plate seated on said wall of said inner casing.

5. A catalytic converter vessel as claimed in claim 4 in which said wall of said inner casing and said plate are welded together.

6. A catalytic converter vessel as claimed in claim 4 in which said wall of said inner casing and said plate are assembled together by a center stay bolt.

7. A catalytic converter vessel comprising an outer casing, an inner casing within the outer casing and having a wall, a plate on the wall of the inner casing and forming a second wall, one of said walls being an inner wall, and the other of said walls being an outer wall, said outer wall having a plurality of louver openings, said inner wall having a plurality of punched holes, said louver openings each being elongated and having a major axis greater than a minor axis, and said holes each having portions thereof in overlapping relation to said louver openings, said overlapping portions each having a dimension greater than the minor axis of a louver opening, but less than the major axis of a louver opening, so that ends of said louver openings are shielded by the wall with the punched openings.

* * * * *